United States Patent [19]

Valli

[11] Patent Number: 4,675,917

[45] Date of Patent: Jun. 30, 1987

[54] UNDERGARMENT WITH INCLUSIVE SHOULDER PADS

[76] Inventor: Laila S. Valli, 57 Godstone Rd., #112, Willowdale, Ontario, Canada, M2J 3C8

[21] Appl. No.: 925,968

[22] Filed: Nov. 3, 1986

[51] Int. Cl.[4] ..... A41D 27/26

[52] U.S. Cl. ..... 2/268; 2/106

[58] Field of Search ..... 2/106, 105, 74, 268

[56] References Cited

U.S. PATENT DOCUMENTS

| | | | |
|---|---|---|---|
| 2,802,216 | 8/1957 | Vogel | 2/268 |
| 2,866,203 | 12/1958 | Costanza | 2/268 |
| 4,411,025 | 10/1983 | Magidson | 2/268 |

*Primary Examiner*—Doris L. Troutman

*Attorney, Agent, or Firm*—Donald E. Hewson

[57] ABSTRACT

A brassiere garment for the female figure incorporates integrated shoulder pad provision. The improved garment has shoulder panels incorporating a pair of pockets for the shoulder pads. In one embodiment, the shoulder pads and associated pockets are shaped to raise the shoulder line; while in a second embodiment in addition to raising the shoulder line the pad extends laterally so as to widen the breadth of the shoulders, by enclosing the top portion of the wearer's arm, to give a squared, broad shouldered appearance. The garment assures total stability of the pads, while in use, at the same time permitting substantially unrestricted normal activity to the wearer without danger of the pads becoming dislodged.

13 Claims, 6 Drawing Figures

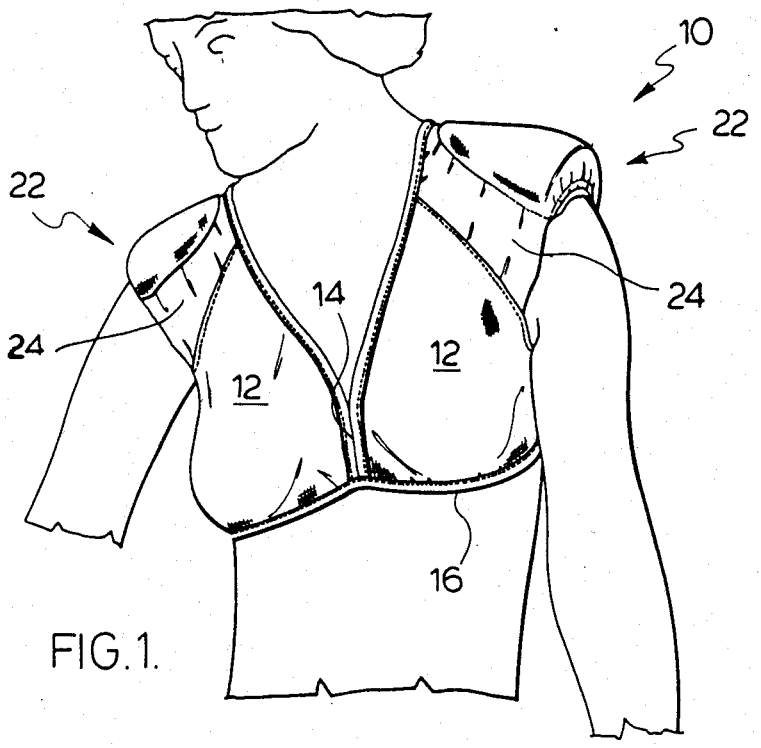
FIG. 1.
FIG. 2.
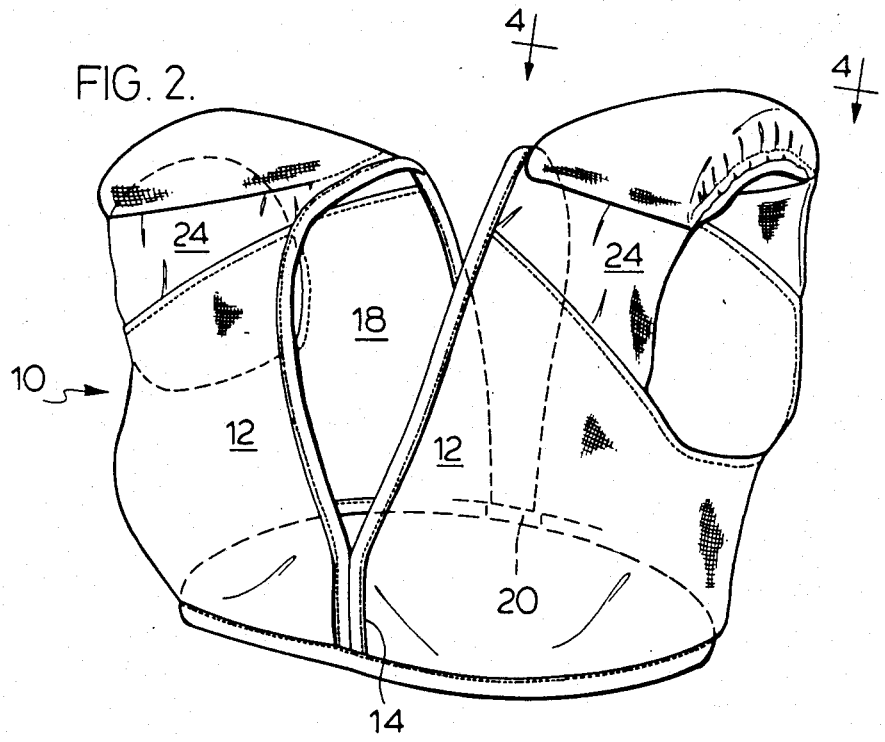

UNDERGARMENT WITH INCLUSIVE SHOULDER PADS

BACKGROUND OF THE INVENTION

This invention is directed to an undergarment, and in particular to a brassiere.

The use of padding for the female figure is almost as old as history itself, and art has long been resorted to when nature has been deemed deficient, or when the fashions of mankind extend demands, figuratively speaking, which are impossible for nature to meet.

In the case of shoulder shape, this portion of the female anatomy has not been totally neglected by the world of fashion, so that the need for the fashion conscious woman to emphasize her shoulder line has been previously dealt with. The simplest way to modify the shoulder silhouette is by the addition of shoulder pads to the garment being worn, and that is precisely what has been previously resorted to. Shoulder pads have been sewn into dresses and coats. They have been secured by pop-studs looped about the shoulder straps of brassieres, and dealt with in a variety of ways.

The gravest drawback of these prior art arrangements was the propensity for unwitting displacement of the shoulder pads. They could slip out of place while being worn, due to the activity of the wearer. They could be misplaced by a would-be user, or lost at the cleaners. In other words, shoulder pads—especially those that are pinned or looped to brassiere, slip, or camisole straps—are not to be relied upon prior to, during, or subsequent to their use.

SUMMARY OF THE PRESENT INVENTION

In accordance with the present invention there is provided a brassiere (or bra) having integrated therewith an over-the-shoulder panel wherein is contained a pad of predetermined shape, to modify to a predetermined extent the shoulder silhouette of the user.

The subject garment comprises a form-fitting portion having a pair of cups or pouches to receive the breasts of the wearer therein. A lower band encircles the torso of a wearer, (usually about the rib cage, in the proximity of the upper diaphragm), having a central fastening located in the front or the back of the garment. The shoulder portions of the garment are tailored to connect with shaped front and rear panel portions, to fit the body of the wearer in a snugly comfortable fashion, thus locating the two shoulder pocket portions in secured, shoulder adhering relation. The shoulder pads are thus not subject to displacement or slipping off the shoulders, when the garment is properly sized and fitted to the wearer. Each of the shoulder portions of the subject garment includes an overlying pocket portion of predetermined shape, within which is inserted and secured a pad of predetermined size and shape, and having a contoured thickness of predetermined form.

In one embodiment, the pad and the accompanying pocket are each of substantially semi-circular shape, having the peripheral inner edge portion of diminished thickness. A substantially straight, diameterical outer edge portion is thickened at the centre thereof and tapers towards the front and back edges, to provide a shoulder edge section of generally crescent form. The outer edge of the pad and its conforming pocket are positioned to coincide in general with the edge of the shoulder of the wearer, with perhaps a certain amount of projection therepast in some instances.

In an alternative embodiment, the pad and accompanying pocket are extended, with the extended portion being of diminishing thickness to provide a tapered edge, and being also downwardly curved to provide a shaped pocket to overlie the shoulder of the wearer and to extend downwardly over a small portion of the upper arm, for a widened shoulder silhouette. The extended pad embodiment provides enhanced location of the upper portion of the garment, in relation to the shoulders of the wearer.

The subject undergarments can be made of fully launderable material, or the material of the padding may be removeable from within the shoulder pockets to facilitate cleaning in regard to the garments, or in respect of the pads per se.

The brassiere with padded shoulders offers a number of advantages to the wearer. From the point of view of style, the wearer can wear clothes having a less precise fit than would otherwise be the case. Moreover, the wearer can purchase and wear clothes without the necessity to worry about the presence or nature of shoulder pads in the garment; or, indeed, can wear otherwise outmoded or over-sized garments and yet be fashionable.

The wearer can be less restrained in her body movements than if wearing prior art separate pads, that were subject to being displaced and a possible source of considerable embarrassment.

The form of the pads of the subject brassieres is restricted only by the extent and capacity of the enclosing pockets, and the provision of access thereto.

In the case of the wearer possessing a fuller figure, the subject garment provides an extended area of load transfer to the top shoulder muscles, such that the discoloration and depression of the flesh into grooves that can be experienced with brassiere straps is virtually totally avoided. The danger of strap breakage or slippage also disappears.

The present invention thus provides a brassiere garment for use by an adult female, the garment having a pair of front panel portions in mutual downwardly converging relation as a neck opening, each panel portion incorporating a pouch-shaped cup portion therein being connected by the lower edges thereof with a torso band, the torso band encircling the bottom of the garment, and a shoulder pad incorporating a shaped and contoured pad enclosure and a corresponding enclosure therefor connected front and back as part of the garment to the torso band, to secure the pad in substantially immoveable relation to a user, when in use.

BRIEF DESCRIPTION OF THE DRAWINGS

Certain embodiments of the invention are described, reference being made to the accompanying drawings wherein;

FIG. 1 is a partial general view of person wearing a first embodiment of the subject garment viewed from the front, the embodiment having thickened pad edges;

FIG. 2 is a general view of the garment first embodiment;

DETAILED DESCRIPTION OF THE PREFERRED EMBODIMENTS

Figure 3:
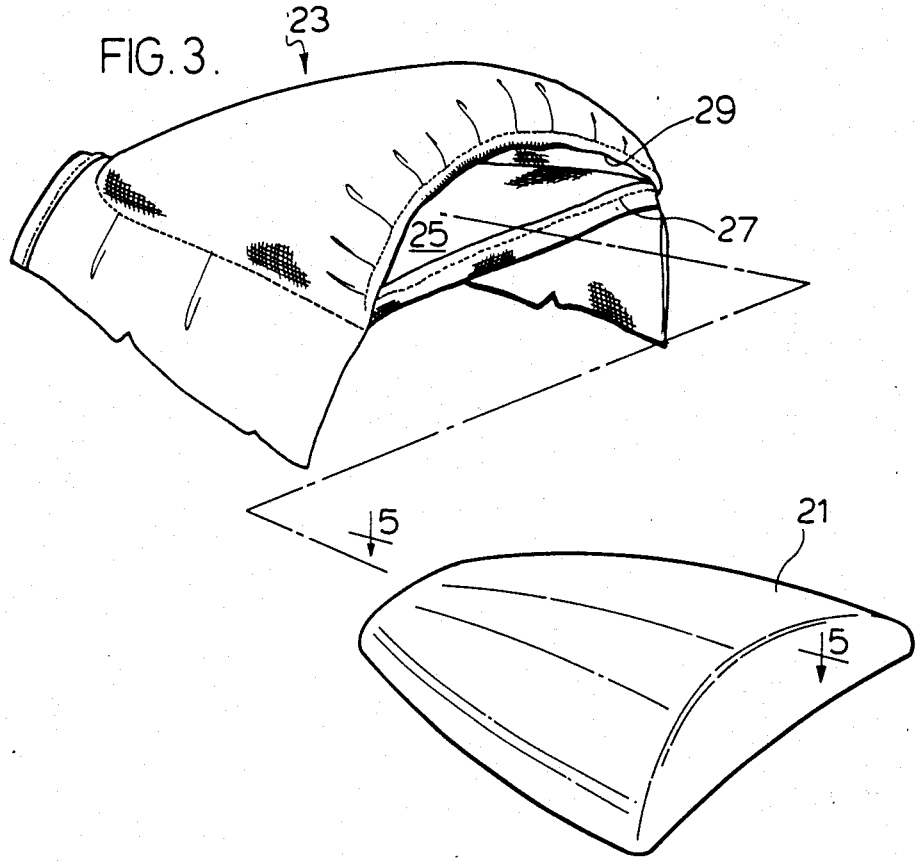
FIG. 3 is a general view of the pad enclosure of the first embodiment, having the pad in disassembled relation.

Referring to FIGS. 1 and 2, the first embodiment 10 comprises a pair of front panels 12 converging downwardly to provide a V-neck, being connected at portion 14. A torso band 16 forms the lower edge of the garment.

The front panels 12 are shaped in known fashion to provide cups for the breasts of the wearer. A pair of back panels 18 also connect with the torso band 16. The torso band 16 has an overlapping portion 20 (shown in phantom in FIG. 2) faced with VELCRO (®) interlocking fastener layers (not shown) to provide a convenient, openable, adjustable fastener. Of course, the garment may also be designed to be openable in the front at 14, where the front panels 12 meet.

A pair of shoulder pads 22 are attached by intermediate panels 24 to the front panels 12 and the back panels 18. The panels 24 also may comprise one of the facings of the pads 22. The pads 22 have an outer covering in the form of a pocket 23, the bottom portion 25 thereof constituting a part of the garment 10.

The included pad portions 21 may comprise one of a number of materials, including synthetic foams and other well known padding materials. In view of the preferred pre-shaping and profiling of the pads, a unitary injection moulded synthetic foam pad is preferred on the basis of control over shape, density, softness, and profile. Also of significance is the capability to impart a built-in concavity to the underside of the pad best illustrated in FIGS. 3 and 5, to complement the shaping effect provided by the pocket and to better accommodate the shoulder of the wearer. The contour of the pad, and resultant variations as to thickness, are predetermined with a view to accommodating the shoulder slope of the user, and to provide a desired shoulder profile.

The torso band 16 may also be configured so that a "Teddy" or camisole can be fixedly or removably attached thereto, for purposes of providing a full undergarment.

Figure 4:
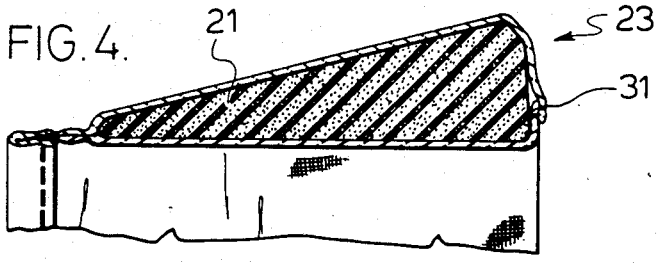
FIG. 4 is a section view taken at 4—4 of FIG. 2.

Referring to FIGS. 3 and 4, the pockets 23 have openable outer edge portions 27, 29 which are secured by fasteners such as VELCRO (®) 31 or dome fasteners, to permit the ready removal of the pads 21, for such purposes as laundering or selective substitution of a pad of differing profile, in order to best meet the needs of the wearer, both in regards to personal hygiene, and for the purposes of elective changes in appearance. Thus, the wearer can change her suit or dress, while at the same time adopting the most appropriate shoulder shape by selection of a particular pad insert, so as to achieve optimum flexibility in use of her available wardrobe. At the same time, the comfort and security of the undergarment are not vacated, which is a tremendous boon in fitting rooms and the like, where there is an absence of total privacy, and time is very much of the essence.

Figure 5:
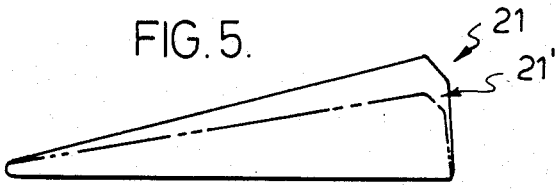
FIG. 5 is a view of the pad of the garment first embodiment taken at 5—5 of FIG. 3.

FIG. 5 shows a first pad 21 of high profile, and in phantom a second pad 21 of lower profile. In the case of mannequins who are modelling haute couture, the need for making extremely rapid changes to their outer garb combined with a capability to rapidly and selectively vary their characteristic frontal silhouette, is met by the provisions of the subject garment.

Figure 6:
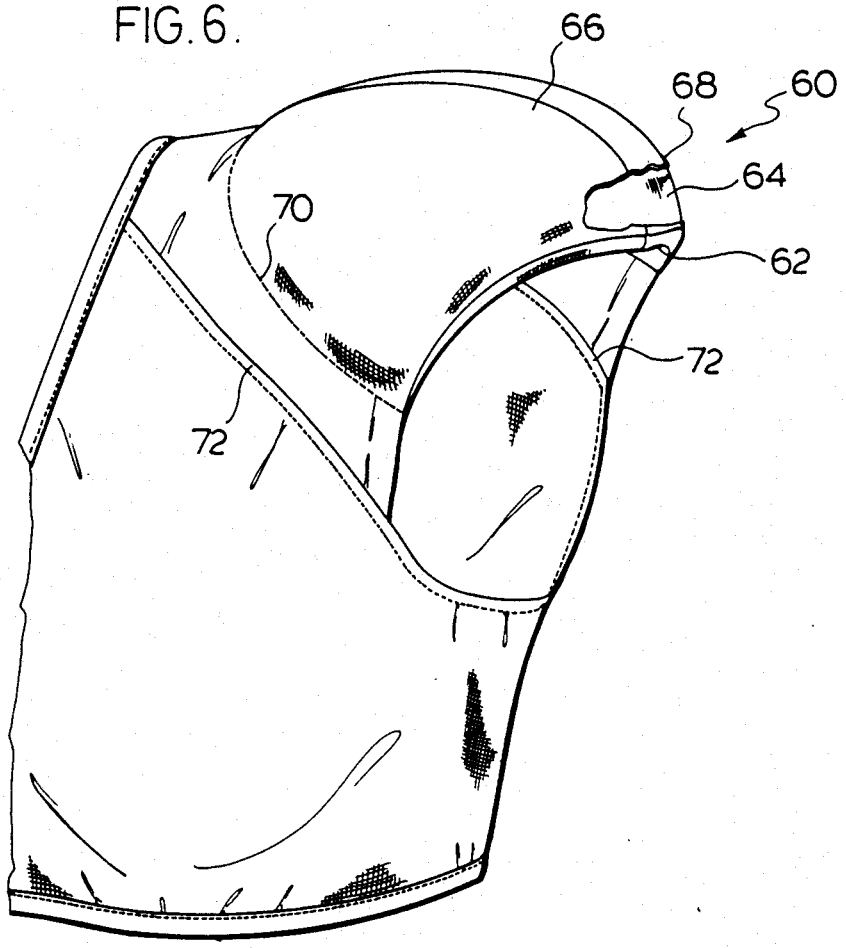
FIG. 6 is a general view corresponding to FIG. 2 of a front panel and shoulder portion of a second embodiment having an extended shoulder pad.

Turning to the FIG. 6 embodiment, the shoulder pad assembly 60 comprises a garment pocket portion 62 shown torn away at the front outer corner, with the corner portion of pad 64 visible therethrough.

The pad 64 has a thickened apex portion 66, generally coincident with the top of the shoulder joint, the portion 68 comprising a downwardly tapering edge cupped in conforming relation to a rounded upper arm and shoulder.

In the FIG. 6 embodiment the pad 64 extends beyond the confines of the seam 70, to as far as the seam 72 in some parts of the garment, so as to provide reinforcement and form thereto without undue bulk.

In reference to any of the above embodiments, there is a design alternative for the back panel area that can be incorporated, which extends the versatility of the undergarment. It can be seen that back panels 18 cover a substantial portion of the wearer's back. In the alternative, the back panels may extend downwardly only a short distance from the shoulders of the wearer onto the back, thus leaving much of the wearer's back exposed. Adjustable straps, such as those typically found on brassieres, could replace the large back panels, and would connect the rear portions of the shoulder pad enclosure portions of the undergarment to the torso band. In such cases, the front panels would be structured more as brassiere cups, except at their upper portions where they extend to the shoulder pad enclosures.

There has been described an undergarment which serves the purposes of a brassiere while at the same time serving to provide a positively fitted and located pair of shoulder pads so as to alter the shoulder profile of the wearer, and so as to place the wearer in a position of meeting the demands of current fashion. The garment may be altered so as to change the shoulder profile electively, at the choice of the wearer. Other specific constructions of the garment, both as a brassiere and as a vehicle to provide a padded shoulder profile, may be made without departing from the spirit and scope of the appended claims.

I claim:

1. A brassiere garment for use by an adult female, said garment having a pair of front panel portions in mutual downwardly converging relation as a neck opening, each said panel portion incorporating a pouch shaped cup portion so as to accommodate the breasts of the wearer therein and being connected at the lower edges thereof with a torso band said torso band and a pair of back panel portions connected at their lower edges to said torso band, encircling the bottom of the garment; and shoulder pad means incorporating a shaped and contoured pad inclosure, and a corresponding enclosure therefore connected to said front and back panel portions, as part of said garment, and being thereby connected to said torso band, so as to secure said shoulder pad means in substantially immoveable relation to a user when in use.

2. The garment as set forth in claim 1, wherein each said shoulder pad terminates at the outer edge thereof at a thickened, upstanding section, to extend upwardly above the shoulder of a user, in use.

3. The garment as set forth in claim 1, wherein each said shoulder pad projects laterally and downwardly to provide in use a shaped cover over a portion of the upper arm of a user.

4. The garment as set forth in claim 3, wherein each said pad is contoured with maximum thickness thereof in a central portion of the pad generally located above the shoulder joint of a user, and tapering in reduced thickness in all directions therefrom.

5. The garment as set forth in claim 4, wherein each said pad is permanently enclosed within said pocket, and has peripheral portions thereof extending outwardly to a position adjacent said neck opening.

6. The garment as set forth in claim 2, wherein each said shoulder pad enclosure has an edge portion thereof openable to provide access for the removal of said pad inclosure therefrom.

7. The garment as set forth in claim 1, wherein said torso band incorporates an openable fastener means therein, to facilitate putting on the garment.

8. The garment as set forth in claim 7, wherein said fastener means compres releasable random hook and fastener means.

9. The garment as set forth in claim 1, wherein said front panel portions each extend rearwardly, having a narrowed portion, the upper edge of which comprises a portion of an arm hole, the rearward panel portion constituting the back panel portions of the garment.

10. The garment as set forth in claim 9, wherein said back panel portions terminate in adjacent, spaced apart relation to provide a deep back profile to the garment.

11. The garment as set forth in claim 1, having intermediate panels connecting said front panel portions, and back panel portions to said shoulder pad enclosure, so as to substantially encase the upper torso of a wearer, in use.

12. The garment as set forth in claim 6, in combination with a plurality of pairs of shoulder pads of differing profile for insertion within said pockets, to permit elective figure variations by a user substituting one pair of pads with a different pair of pads.

13. The garment as set forth in claim 1, wherein each said back panel includes one or more adjustable straps.

* * * * *